United States Patent [19]

Kraic

[11] Patent Number: 4,850,831

[45] Date of Patent: Jul. 25, 1989

[54] INTERENGAGING ROTORS HAVING INTERNAL AXES AND SPECIFIC SIDEWALL CONSTRUCTION

[75] Inventor: Otto Kraic, Lindau, Fed. Rep. of Germany

[73] Assignee: H. C. Felix Wankel, Lindau, Fed. Rep. of Germany

[21] Appl. No.: 207,662

[22] Filed: Jun. 16, 1988

Related U.S. Application Data

[63] Continuation of Ser. No. 902,147, Aug. 29, 1986, abandoned.

[30] Foreign Application Priority Data

Aug. 31, 1985 [CH] Switzerland ..... 03741/85

[51] Int. Cl.[4] ..... F01C 1/10

[52] U.S. Cl. ..... 418/168

[58] Field of Search ..... 418/166–171

[56] References Cited

U.S. PATENT DOCUMENTS

| | | | |
|---|---|---|---|
| 724,994 | 4/1903 | Cooley | 418/166 |
| 1,787,543 | 1/1931 | Nichols | 418/168 |
| 2,053,919 | 9/1936 | Pigott | 418/168 |
| 2,458,958 | 1/1949 | Pigott et al. | 418/168 |
| 2,539,044 | 1/1951 | Walsh | 418/168 |

FOREIGN PATENT DOCUMENTS 325849 9/1920 Fed. Rep. of Germany ..... 418/169

*Primary Examiner*—John J. Vrablik

*Attorney, Agent, or Firm*—Ladas & Parry

[57] ABSTRACT

The external rotor of a single-rotation machine has engagement spaces, whose boundary faces in the inward direction form a widening, which is adjacent in an outer region radial thereto to parallel surfaces or surfaces forming a widening in the outward direction. The side walls axially bounding these engagement spaces have a radially outer part, which is cast in one piece with the peripheral parts of the external rotor and an inner part radial thereto, which subsequently reduces to a circular opening the opening surrounded by the radially outer parts, so that the radial seal between side walls and a stationary sealing member surrounded by said opening is located radially within the peripheral parts of the external rotor and a sealing gap in the radial plane between the peripheral parts and the sealing member is avoided. The joining of peripheral parts and the radially outer side wall parts in one piece makes it possible to obtain the necessary high dimensional accuracy required for a good machine efficiency and this is accompanied by low manufacturing costs.

5 Claims, 4 Drawing Sheets

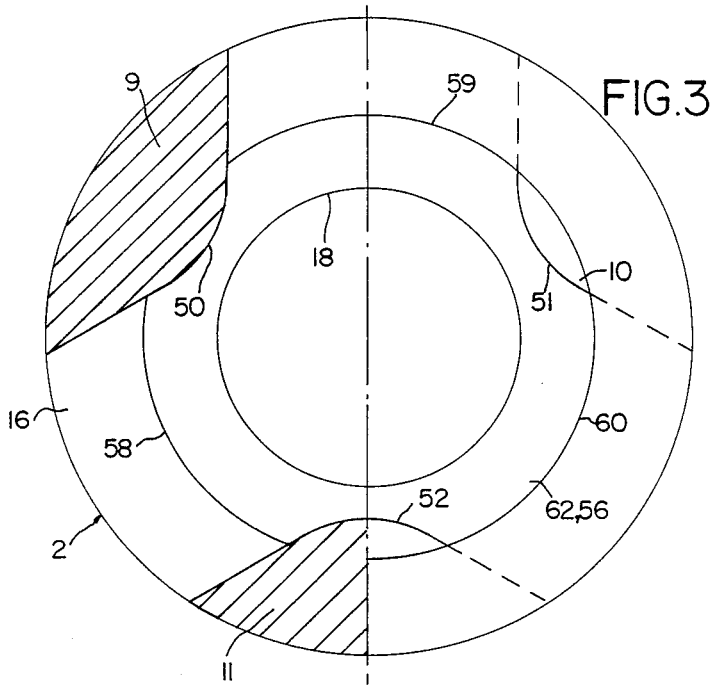
FIG.3
FIG.4
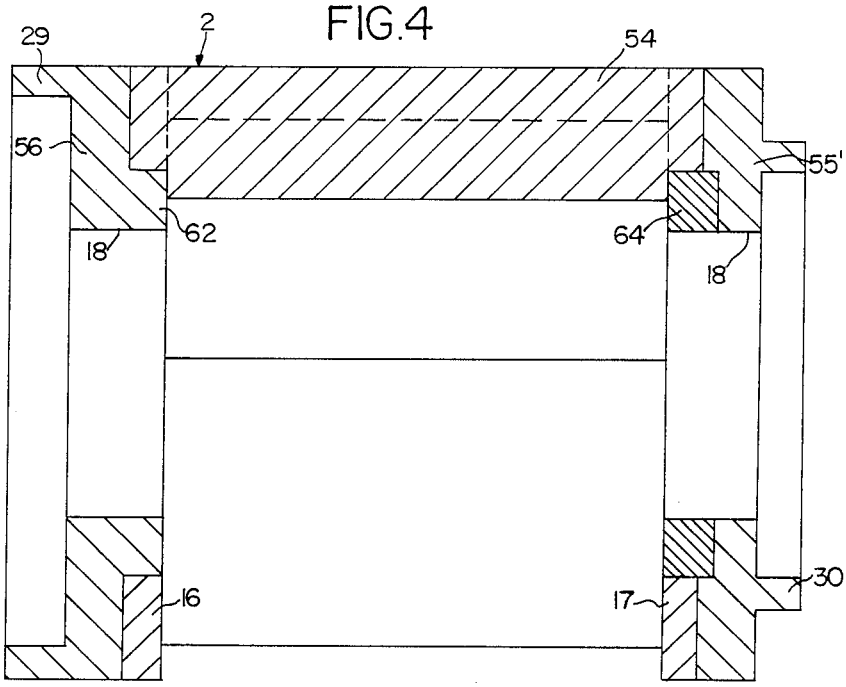

INTERENGAGING ROTORS HAVING INTERNAL AXES AND SPECIFIC SIDEWALL CONSTRUCTION

This is a continuation of co-pending application Ser. No. 902,147 filed Aug. 29, 1986, abandoned.

BACKGROUND OF THE INVENTION

The invention relates to an internal axes single-rotation machine, whose external and internal rotors are rotatable about parallel geometrical axes running through the centre of gravity thereof with a uniform angular velocity differing in an integral ratio, the surfaces bounding the engagement spaces of the external rotor in the circumferential direction in the inwards direction form a widening adjacent to an outer region radial thereto with parallel surfaces or surfaces forming a widening in the outwards direction, the engagement spaces in the axial direction being bounded by surfaces of side walls at right angles to the axis.

Numerous different constructions of such machines are known. A machine with a speed ratio between the external and internal rotor of 2:1 is e.g. known from U.S. Pat. No. 4,540,356. Machines in which this speed ratio is 3:2 and 4:3 are described in the not previously published U.S. Pat. No. 4,714,417. As a result of the mounting of their two rotors about axes passing through the centre of gravity thereof, such machines are suitable for very high rotational speeds, so that in the case of small dimensions they can be realized for a high drive throughput. However, the pressure level attainable when used as a compressor is greatly dependent on the precision of manufacture. Furthermore, the efficiency when used as a machine driven by a gas flow, i.e. as a driver is dependent on the precision of manufacture or the accuracy of the reciprocal engagement of the rotors. Therefore it has not hitherto proved possible to manufacture machines of the aforementioned type with satisfactory performance characteristics as a mass product, i.e. at an acceptable cost. The engagement spaces of the external rotor having undercuts made it necessary to assemble the external rotor from separately manufactured components, so that on joining together the components dimensional inaccuracies were unavoidable, as was a correspondingly large clearance between the external and internal rotors. However, when not using packing strips, the clearance at the engagement points between the two rotors, i.e. the size of the sealing gap present thereat is decisive for the attainable machine ouput.

SUMMARY OF THE INVENTION

The object of the present invention is to disclose a machine of the aforementioned type, whose rotors can be constructed in such a way and with relatively low manufacturing costs that there are particularly narrow sealing gaps between them and the machine efficiency is correspondingly particularly high. According to the invention this problem is solved in that a radially outer part of the side walls of the external rotor is shaped in one piece therewith and at least one body fixed to an axial end of the external rotor forms the radially inner part of these side walls. With a circular recess concentric to the external rotor axis, said body sealingly surrounds a stationary sealing member, which defines the radially inner space of the machine in the axial direction and through which is passed the shaft of the internal rotor.

The invention also relates to a method for the manufacture of a machine according to the invention, as well as to a casting mould for performing the method of manufacture.

Due to the fact that, according to the invention, part of the side walls is shaped in one piece with the external rotor, the surfaces bounding the engagement spaces in the circumferential direction are firmly fixed to one another as a result of the actual manufacturing process and can be manufactured with the precision attainable in the casting process either axially parallel or with a precise reciprocal orientation, so that the internal rotor can engage in said engagement spaces with particularly narrow sealing gaps.

DESCRIPTION OF THE DRAWINGS

The invention is described in greater detail hereinafter relative to an embodiment shown in the drawings, wherein show:

FIG. 3 A half-radially sectioned end view of the external rotor according to FIG. 2.

FIG. 4 An axial section through the an external rotor.

FIG. 1 illustrates the per se known general operating principle of an internal axes single rotation machine. Its two rotors 2, 3 rotate about spaced geometrical axes 5, 6, which are fixed with respect to the machine housing or casing 4. The arrangement is comparable with an internally toothed gear with a gear ratio of 3:2and therefore a speed ratio of 2:3. The individual phases of the relative movement between the external rotor 2 and the internal rotor 3 are shown in FIG. 3 of U.S. Pat. No. 4,714,417. The circular cylindrical inner face of the machine casing 4 surrounds with a narrow gap the cross-sectionally arcuate outer face 8 of the sector-shaped peripheral parts 9, 10, 11, so that they control the inlets and outlets 12, 13 of the machine casing.

Figure 1:
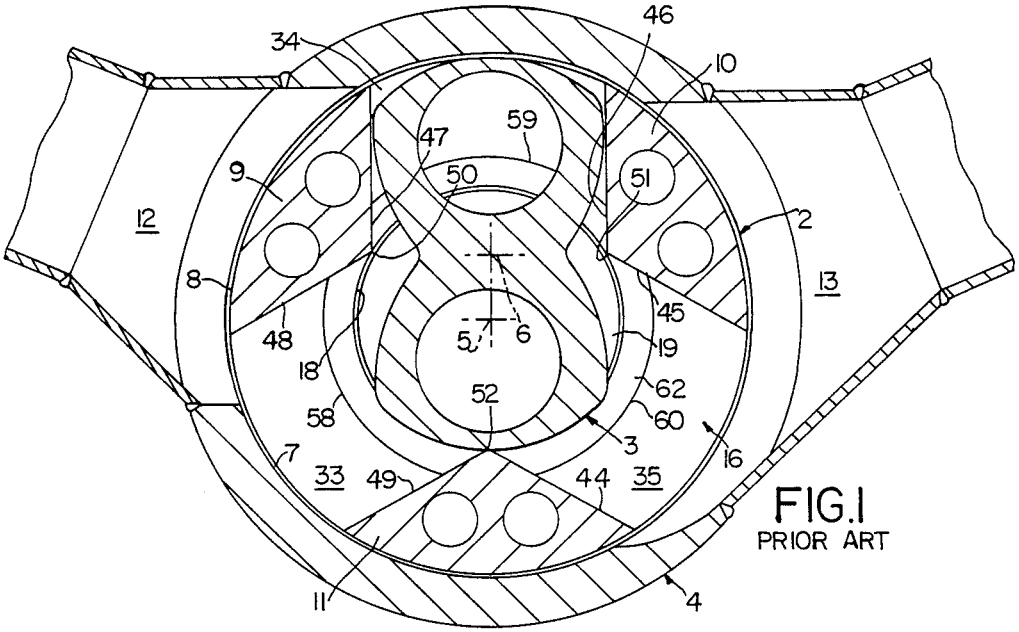
FIG.1 PRIOR ART
FIG. 1 A radial section through a machine of the prior art.

As the external rotor 2 must surround the journals 14, 15, which rotate on fixed geometric axes which are displaced with respect to its axis 5, its side parts 16, 17 interconnecting its peripheral parts 9, 10, 11, surround an adequately large circular opening 18 for this purpose. This opening is closed by a sealing member 19 or 20 fixed to the machine casing 4 and through which is passed the particular journal 14, 15.

One of the journals 14 of internal rotor 3 carries a gear 22, which meshes with a hollow gear 23 fixed to the external rotor 2, although such a driving connection resulting from the reciprocal meshing engagement between the two rotors 2, 3 is also avoidable.

The two rotors 2, 3 are mounted by means of ball bearings 25, 25', 26 for the journals 14, 15 of the internal rotor 3 or by ballbearings 27, 28 for in each case one hub part 29, 30 of external rotor 2, which is supported on the sealing members 19, 20 on either side either directly or via a bearing block 32 connected therewith.

For a good reciprocal sealing of the engagement spaces 33, 34, 35 of external rotor 2 along the plane of the radially directed side faces 36, 37, along which the end faces 38, 39 of internal rotor 3 move, the diameter of the opening 18 surrounded by side parts 16, 17 and therefore the external diameter of the sealing members 19, 20 in this area is kept as small as possible and is at the most of a magnitude such that it does not extend over the sector-shaped peripheral parts 9, 10,11. Thus, simple radial seals 40, 41 can be used for bringing about the sealing between the side parts 16, 17 rotating with external rotor 2 and the fixed sealing members 19, 20 and it is possible to avoid a sealing gap located in said radial plane between the side faces of the sector-shaped peripheral parts 9, 10, 11 of the external rotor 2 and the faces of the sealing members 19, 20 which are parallel thereto and bound the engagement spaces 33, 34 35. The manufacture of an external rotor, whose faces 44 to 49 circumferentially define the engagement spaces 33, 34, 35 have an undercut, which in the represented embodiment is formed by a rounded portion 50, 51, 52 of the cross-section of the sector-shaped peripheral parts 9, 10, 11 in the apex region thereof, could not for the reasons indicated hereinbefore take place with acceptable expenditure in one piece, so that following separate manufacture, the peripheral parts 9, 10, 11 had to be joined with the side parts of the external rotor and it was necessary to accept correspondingly large tolerances, particularly in the case of the precise parallel reciprocal association of said peripheral parts.

The external rotor 2 of a machine according to the invention comprises a casting 54 and two hub bodies 55, 56 laterally fixed thereto. Casting 54 comprises the sector-shaped peripheral parts 9, 10, 11 and the side parts 16, 17 interconnecting the same and whereof there must consequently be three pairs. Their shape is arcuate and has a width in the radial direction which is smaller than the maximum dimension of the sector-shaped peripheral parts 9, 10, 11 in the radial direction. Therefore the rounded portions 50, 51, 52 of the peripheral parts 9, 10, 11 are located within a circle concentric to the axis 5 of external rotor 2 and which runs along the radially inner boundary edges 58, 59, 60 of the arcuate side parts 16, 17. To ensure that the radial seal 40, 41 is not overlapped by the peripheral parts 9, 10,11 or located within a circle touched by the rounded portions 50, 51, 52 and which according to FIG. 1 coincides with the opening 18, an inner, axially projecting edge 62, 63 (FIG. 6 ) of the hub bodies 55, 56 or a ring 64 (FIG. 4) inserted between casting 54 and the particular hub body 55' engages radially between the side parts 16, 17 of external rotor 2 and the sealing bodies 19, 20 and consequently surrounds opening 18, so that the radial seal 40, 41 is located between said edge 62, 63 of the hub body or the inserted ring 64 (FIG. 4) and the sealing body 19, 20.

Figure 2:
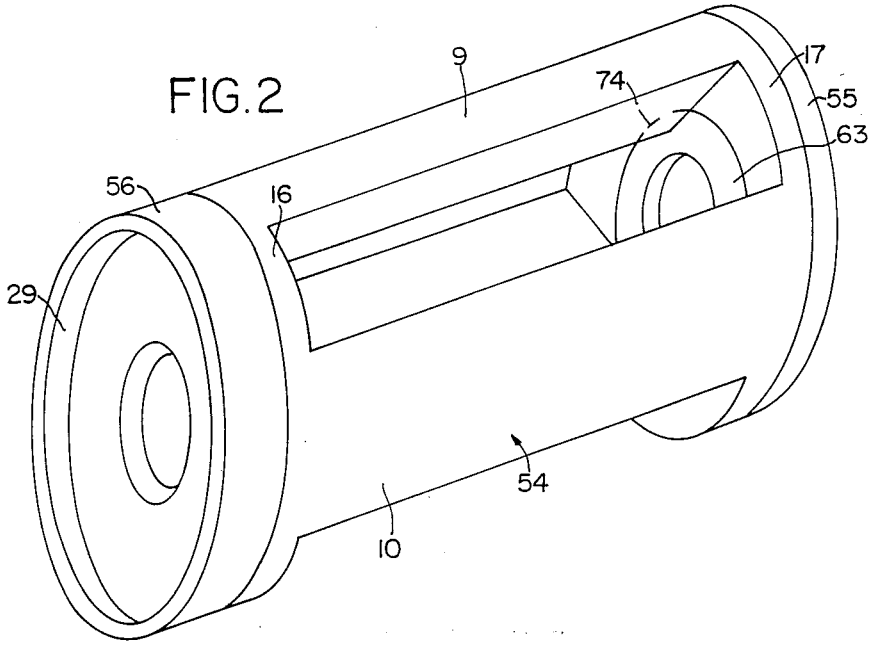
FIG. 2 A perspective representation of an inventively constructed external rotor of a machine corresponding to FIG. 1.
Figure 3A:
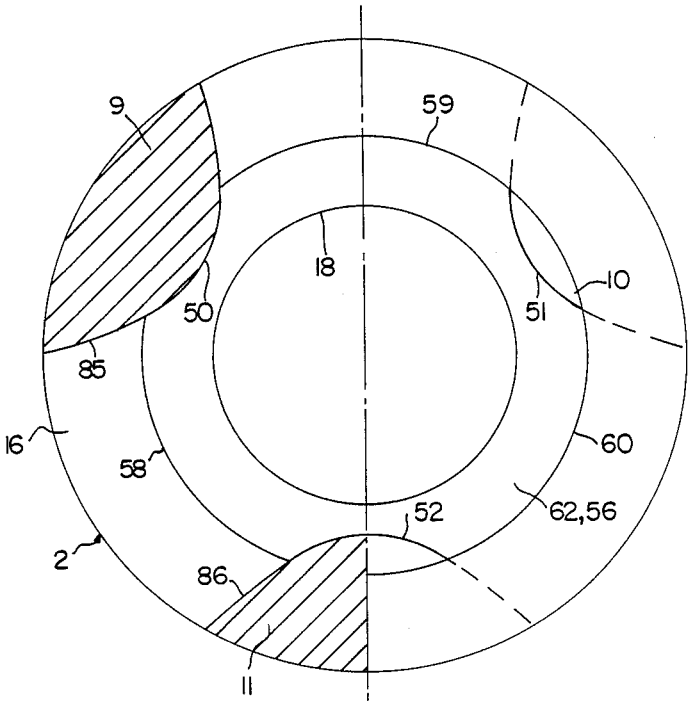
FIG. 3*a* is a half-radially section end view of the external rotor.

The construction of external rotor 2 can best be gathered from FIGS. 2, 3 and 4. The right-hand part of FIG. 4 shows an embodiment with an inserted ring 64, which could also be provided on the opposite side of the external rotor.

Figure 6:
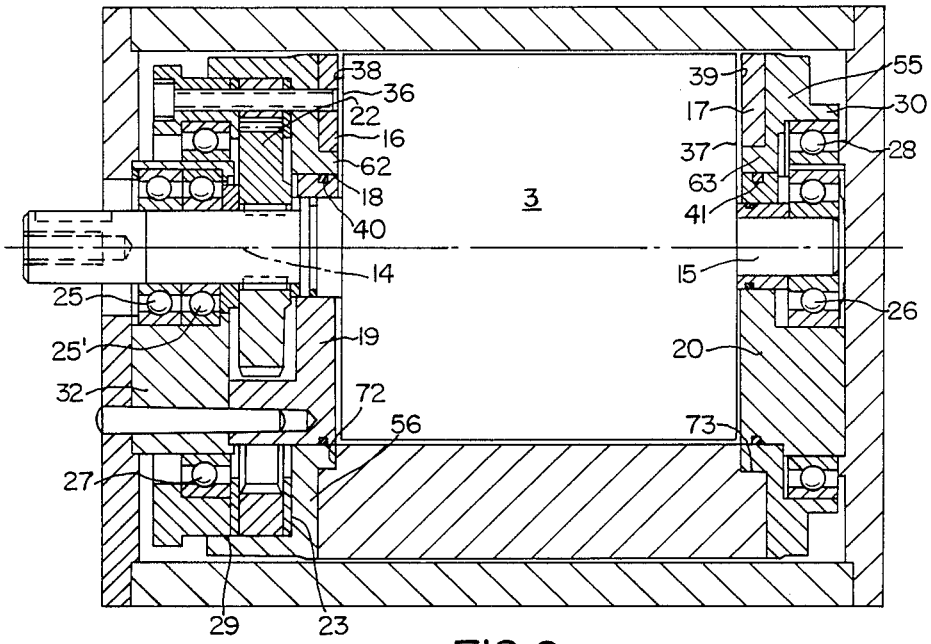
FIG. 6 An axial section through a machine according to the invention.
Figure 5:
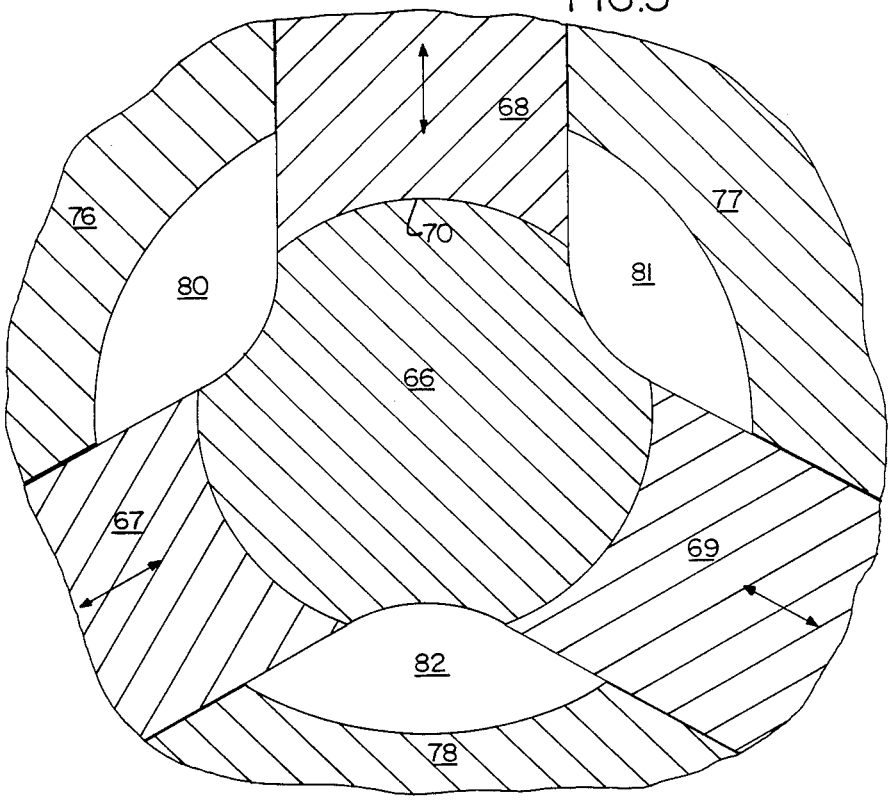
FIG. 5 A radial section through the casting mould for producing the external rotor.

The described external rotor 2 has the important advantage of an inexpensive and very dimensionally accurate manufacture in a casting mould shown in simplified form in FIG. 5. Due to the fact that the side parts 16, 17 forming a portion of the same casting 54 are located further radially outwards than the rounded portions 50, 51, 52 forming the undercuts, the latter can be formed by an inner mould part 66 and the completed casting 54 can be removed axially from said part 66 or mould part 66 can be taken axially out of casting 54. The side wall parts 16, 17, which would impede an axial mould removal movement are formed by radially movable mould sliders 67, 68,69. It is obvious that the surfaces 70 engaging with one another when the mould is closed could be planar instead of arcuate. At its two ends, the inner mould part 66 has a circular collar, through which is formed the arcuate inner boundary edge 58, 59, 60 of side parts 16, 17, which are continued in an all-round angular slot 72, 73 (FIG. 6). Angular slot 72, 73 is provided for engaging the edge 62, 63 of hub body 55, 56 and consequently extends behind and past the ends of peripheral parts 9, 10, 11, as indicated by the dotted line 74 in FIG. 2.

Thus, together with the outer mould parts 76, 77, 78, the mould sliders 67, 68, 69 and the inner mould part 66 form three mould cavities 80, 81, 82, which are interconnected at their ends for forming the side parts 16, 17 of the external rotor 2. The mould parts are metallic and permit a high dimensional accuracy and surface quality of casting 54, so that the latter does not have to be mechanically worked.

It is obvious that, diverging from the represented embodiment, the external rotor 2 can be given different shapes. For example, the engagement spaces 33 to 35 can be bounded by surfaces 85, 86, which move apart to the outside or are curved to the outside, as indicated by the lines in FIG. 3*a*, instead of being constituted by planar, parallel surfaces 44 to 49. It is also obvious that only those embodiments of the machine are possible in which the internal rotor 3 can for assembly purposes be inserted from the outside radially inwards into external rotor 2.

I claim:

1. Internal axes single-rotation machine, whose external and internal rotors (2,3) rotated about parallel geometrical axes (5,6) passing through the center of gravity thereof and with uniform angular velocity differing in an integral ratio, the external rotor having engagement parts (9, 10, 11) defining engagement spaces (33, 34, 35), the engagement spaces (33, 34 35) of the external rotor (2) enlarging in the radial inward direction to form radial inner curved parts (50, 51, 52), the engagement spaces (33, 34, 35) being axially bounded by sidewalls (16, 17, 62–64) which are at right angles to the axis (5), whereby a radially outer part (16, 17) of said sidewalls (16, 17, 62–64) of the external rotor (2) bounding the engagement spaces (33, 34, 35) is formed in one piece (54) with the engagement parts (9, 10, 11) of said rotor and at least one body (62–64) fixed to an axial end of the external rotor (2) forms the radially inner part of said sidewalls (16, 17, 62–64), a stationary sealing member (19, 20) closing said recess and and surrounds a circular recess 18 concentric to the axis of the external rotor being sealingly surrounded by said body (62–64) and which axially defines the radially inner space of the machine and through which is passed the shaft (14, 15) of the internal rotor (3).

2. Machine according to claim 1, whereby the radially inner part of said side walls (16, 17, 62–64) of the external rotor (2) is formed by a rim (62, 63) axially projecting from a hub body (55, 56) fixed to the external rotor (2).

3. Machine according to claim 1, whereby the radially inner part of the side walls (16, 17, 62–64) of the external rotor (2) is formed by a ring (64), which is held between the engagement parts (9, 10, 11) of the external rotor (2) and a body (55') laterally fixed to the external rotor (2) and a body (55') laterally fixed to the external rotor (2), thereby bridging the boundary surface between them.

4. Machine according to claim 1, whereby the surfaces of the engagement parts (9, 10, 11) bounding the engagement spaces (33, 35) in the circumferential direction pass into one another pairwise (45, 46; 47, 48; 49, 44) via said curved part (50–52) forming the radial inner enlargement thereof.

5. Machine according to claim 4, whereby said curved parts (50–52) pass radially outwards into planar surfaces (44–49) bounding the engagement spaces (33–35), the radially inner parts (62–64) of the sidewalls (16, 17, 62–64) extending radially outwards at least up to the transition point between the curved parts (50–52) and the planar surfaces (44–49).

* * * * *